US007677861B1

(12) United States Patent
Fehringer

(10) Patent No.: US 7,677,861 B1
(45) Date of Patent: Mar. 16, 2010

(54) SLAT REPLACEMENT MACHINE

(76) Inventor: Joseph V. Fehringer, 46 Kramer Dr., Columbus, NE (US) 68601

( * ) Notice: Subject to any disclaimer, the term of this patent is extended or adjusted under 35 U.S.C. 154(b) by 1316 days.

(21) Appl. No.: 11/148,075

(22) Filed: Jun. 8, 2005

(51) Int. Cl.
*B66C 23/00* (2006.01)

(52) U.S. Cl. ..... 414/680; 212/231; 212/302

(58) Field of Classification Search ..... 414/680; 180/9.1, 6.7; 212/195, 231, 302–305, 901; 280/763.1, 764.1, 765.1, 766.1
See application file for complete search history.

(56) References Cited

U.S. PATENT DOCUMENTS 2,804,979 A * 9/1957 Lassiter ..... 212/301
4,329,109 A * 5/1982 Den Bleyker ..... 414/685
4,558,758 A * 12/1985 Littman et al. ..... 180/8.1
5,465,525 A * 11/1995 Mifune et al. ..... 43/132.1
6,065,621 A * 5/2000 Fatemi et al. ..... 212/301

FOREIGN PATENT DOCUMENTS

WO WO 2004/089804 * 10/2004

OTHER PUBLICATIONS 12 pages from the "doeden-concrete-slat-replacer.com" Internet web site with respect to the Doeden Slat Replacer; printed Nov. 17, 2004.

* cited by examiner

*Primary Examiner*—Donald Underwood
(74) *Attorney, Agent, or Firm*—Dennis L. Thomte; Thomte Patent Law Office LLC

(57) ABSTRACT

A slat replacement machine having an elongated rectangular frame supported at each end by a tracked drive unit which provides zero turn capability to the machine. A pair of outrigger assemblies is provided at the forward end of the frame and a pair of outrigger assemblies is provided at the rearward side of the frame. The outrigger assemblies may be pivotally moved from a stowed position adjacent the frame to an outwardly extending position. A telescopic boom is pivotally mounted on the upper end of a rotatable pedestal which extends upwardly from the center of the frame. Various components of the machine such as hydraulic cylinders and hydraulic motors are radio controlled.

19 Claims, 7 Drawing Sheets

SLAT REPLACEMENT MACHINE

BACKGROUND OF THE INVENTION

1. Field of the Invention

This invention relates to a slat replacement machine and more particularly to a self-propelled machine which has zero turn capability and which may be used to replace concrete slats in a livestock building such as a hog confinement building or the like.

2. Description of the Related Art

Livestock buildings such as hog confinement buildings normally include a slatted floor suspended above a waste pit. The slatted floor is commonly comprised of a plurality of pre-cast concrete slats which are usually ten feet long and four feet wide and may weight as much as 2200 pounds. The slats have elongated spaced-apart openings or slits formed therein which permit animal waste and flush water to pass therethrough into the waste pit. The installation of the concrete slats in a new building is relatively uncomplicated due to the fact that the floor is normally installed prior to the completion of the side walls and roof of the building. Over a period of time, the concrete slats may deteriorate and may collapse causing injury or death to the animals within the building. Thus, it is frequently necessary to replace the worn slats but the replacement of the slats is complicated by the fact that the building may have narrow doors which makes it difficult to utilize large equipment to lift the worn slats from their supporting surface and remove the same from the building. Frequently, it is necessary to remove a portion of the roof of the building or a wall of the building to enable large equipment to replace the slats. The worn condition of the slats also makes it difficult to support heavy equipment thereon which is used to replace the slats.

At least one slat replacement machine has been provided for the slat replacement process but that machine is believed to be extremely expensive, inconvenient to use and requires that an operator physically be present on the machine to operate the same. It is also believed that the prior art machine does not have the necessary versatility and maneuverability that is required in the slat replacement process.

SUMMARY OF THE INVENTION

A slat replacement machine is provided which comprises a generally horizontally disposed rectangular frame having a forward side, a rearward side, and opposite ends. A selectively reversibly driven tracked drive unit is mounted at each end of the frame to support the frame approximately three inches above the floor and which enables the frame to be moved forwardly, rearwardly, or in a zero turn fashion. The overall length of the frame with the tracked drive units thereon is approximately 9.5 feet with the width of the machine being approximately 32 inches so that the machine may be moved through a standard 36 inch door opening.

A pair of outrigger assemblies are secured to the forward side of the machine and a pair of outrigger assemblies are secured to the rearward side of the machine. Each of the outrigger assemblies may be moved from a stowed position adjacent the frame to an operative position extending outwardly from the frame. Each of the outrigger assemblies includes a manually operated screw jack which is used to lower the outer end of the outrigger assembly into sliding floor engagement.

A selectively rotatable pedestal is mounted on the frame at the center thereof and extends upwardly therefrom. A telescoping boom assembly is pivotally mounted on the upper end of the pedestal about a horizontal axis. The boom assembly comprises a first tube which is pivotally mounted on the upper end of the pedestal, about a horizontal axis, and which has a second tube selectively manually slidably mounted therein which may be moved between retracted and extended positions. A third tube is slidably mounted within the second tube and is moved between retracted and extended positions by means of a hydraulic cylinder which is secured to and extends between the second tube and the third tube. A lifting hook or the like is provided on the outer end of the third tube for attachment to a slat. A hydraulic cylinder is pivotally secured to and extends between the pedestal and the first tube for raising and lowering the boom assembly.

A power means such as an internal combustion engine or electric motor is provided on the frame with drives a hydraulic pump for supplying hydraulic fluid under pressure to the various hydraulic motors and hydraulic cylinders of the machine. The hydraulic cylinders and motors are controlled by an electro-mechanical valve controller which may be either manually operated or which may be radio controlled by means of a transmitter and receiver. The receiver is positioned on the frame means and the transmitter is hand-carried by an operator who is positioned remote from the machine.

It is therefore a principal object of the invention to provide an improved slat replacement machine.

A further object of the invention is to provide an improved slat replacement machine which is highly maneuverable and, versatile.

A further object of the invention is to provide a slat replacement machine which is economical of manufacture and durable in use.

Yet another object of the invention is to provide a slat replacement machine which does not require the presence of an operator thereon.

Still another object of the invention is to provide a slat replacement machine which has zero turn capability.

Still another object of the invention is to provide a slat replacement machine which may be moved into a livestock building through a conventional 36 inch door opening.

Still another object of the invention is to provide a slat replacement machine which may be moved into the livestock building through the side curtain opening in the side wall or end wall of the building.

A further object of the invention is to provide a slat replacement machine which is radio controlled.

These and other objects will be apparent to those skilled in the art.

DETAILED DESCRIPTION OF THE INVENTION

Figure 1:
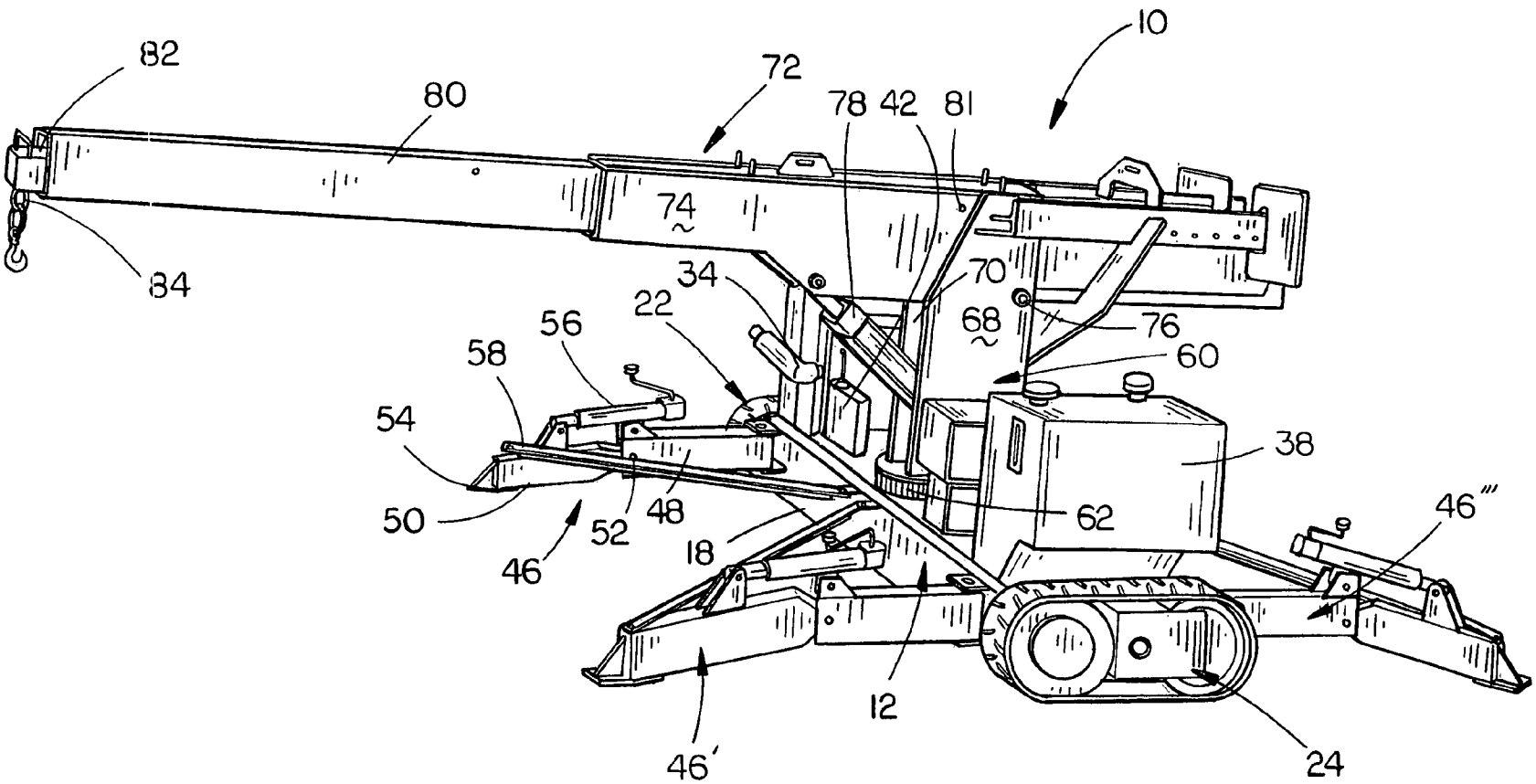
FIG. 1 is a front perspective view of the machine of this invention.

The numeral 10 refers generally to the concrete slat replacer machine of this invention. Machine 10 includes an elongated, generally rectangular frame 12 having a first end 14, a second enc 16, a forward side 18, and a rearward side 20.

A selectively reversible drive unit 22 is provided on end 14 of frame 12 and a selectively reversible drive unit 24 is provided on end 16 of frame 12. In the preferred embodiment, drive unit 22 includes an endless rubber track 26 driven by a reversible hydraulic motor 28 and drive unit 24 includes an endless rubber track 30 driven by a reversible hydraulic motor 32. Each of the hydraulic motors 28 and 32 are independently controllable so that the machine 10 has zero turn capability. Preferably, the distance from the outside of track 26 to the outside of track 30 is approximately 9.5 feet so that the machine may be positioned on a ten-foot concrete slat. Preferably, the distance between the forward side 18 to the rearward side 20 is approximately 22.5 inches while the drive units have a length of approximately thirty-two inches. Preferably, the lower end of frame 12 is positioned approximately three inches above the bottom of the drive units 22, 24.

A power means such as an internal combustion engine 34, preferably diesel or electric motor, is mounted on frame 12 adjacent end 14 for driving a hydraulic pump 36. Hydraulic reservoir 38 is fluidly connected to pump 36 in conventional fashion as is electro-mechanical valve controller 40 which is operated either manually or by radio control. Radio receiver 42 is mounted on frame 12 which is operatively connected to the valve controller 40 for operating the various hydraulic cylinders and hydraulic motors on the machine. Radio receiver 42 receives radio signals from a hand-held transmitter 44 carried by an operator so that the machine 10 is remotely controllable.

Figure 2:
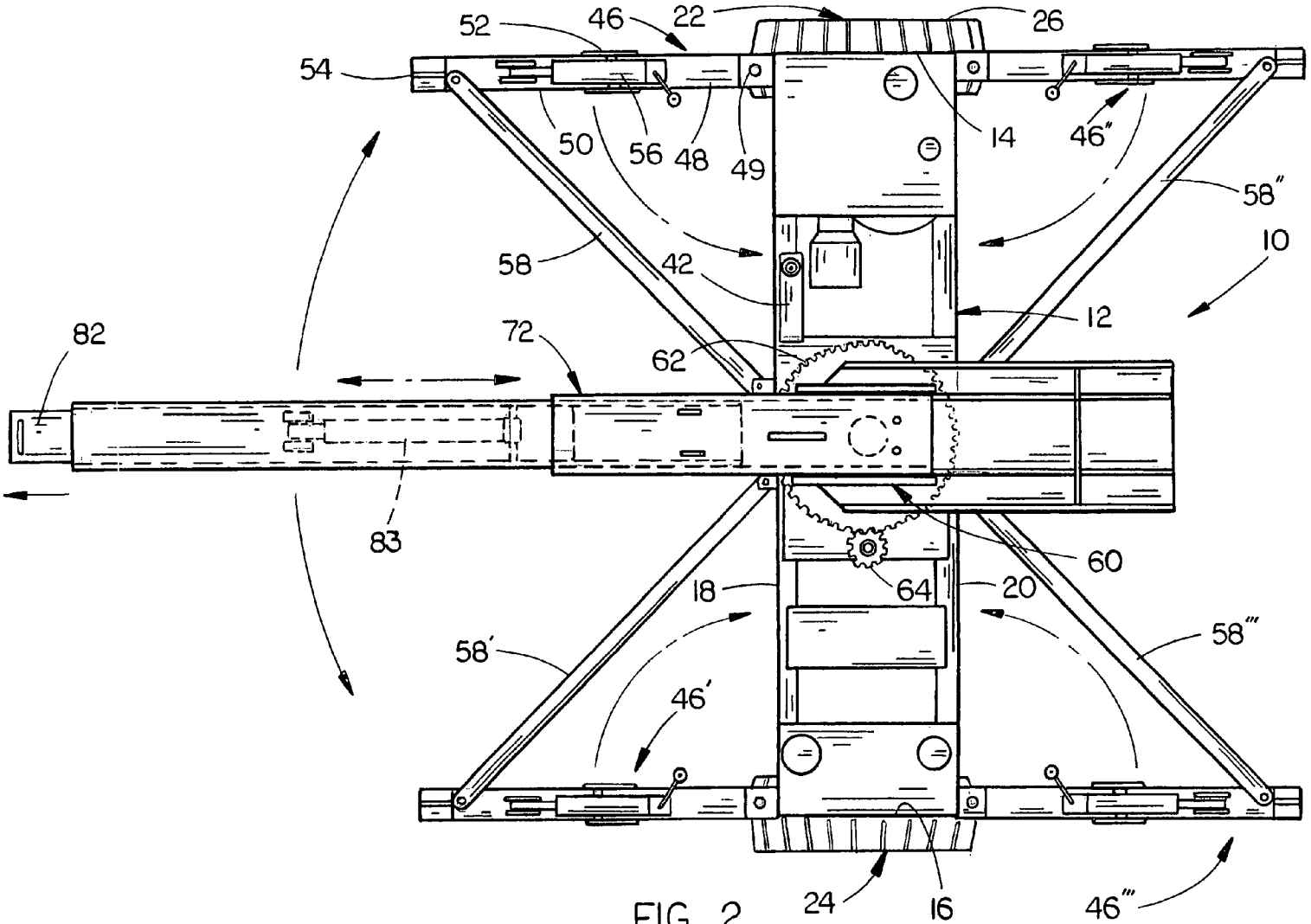
FIG. 2 is a top elevational view of the machine.

Outrigger assembly 46 has its inner end 48 pivotally secured, about a vertical axis 49, to the forward side 18 of frame 12 adjacent end 14. Outrigger assembly 46 is selectively pivotally movable from a stowed position adjacent the forward side 18 of frame 12 (FIG. 4) to an operative position wherein the length of the outrigger assembly 46 is substantially transversely disposed with respect to frame 12 (FIGS. 1, 2). Outrigger assembly 46 includes an inner member 48 having an outer member 50 pivotally secured thereto about a horizontal axis at 52. The lower outer end of outer member 50 is provided with a shoe 54 adapted to slidably engage a concrete slat or concrete floor upon which the machine 10 is supported or the next adjacent concrete slat. A length adjustable actuator or screw jack 56 is pivotally connected to and extends between members 48 and 50 so that the outer member 50 may be raised and lowered with respect to inner member 48. An elongated brace 58 is selectively pinned to and extends between the outer end of outer member 50 and the forward side 18 of frame 12 to maintain the outrigger assembly 46 in its operative position. When the outrigger assembly 46 is positioned in its stowed position of FIG. 4, the outer end of outer member 50 is pinned to frame 18 at 59 and the brace 58 is stowed, as will be described hereinafter. Outrigger assembly 46' is secured to the forward side 18 of frame 12 and is identical to outrigger assembly 46. Outrigger assemblies 46" and 46'", which are identical to outrigger assembly 46, are secured to the opposite ends of frame 12 at the rearward side 20 of frame 12. Braces 58', 58" and 58'" maintain the outrigger assemblies 46', 46" and 46'" in their operative positions, respectively, as seen in FIG. 2.

The numeral 60 refers to an upstanding pedestal or turret which is rotatably mounted, about a vertical axis, to frame 12 at the center thereof. Pedestal 60 includes a toothed ring gear 62 at its lower end which is in engagement with a toothed drive gear 64 which is operatively secured to the drive shaft of a reversible hydraulic motor 66 so that pedestal 60 may be selectively rotated with respect to frame 12. Pedestal 60 includes a pair of horizontally spaced-apart support members 68, 70, as seen in the drawings. Limit switches LS1 and LS2 are mounted on frame 12 and are engaged by brackets B1 and B2, respectively, to limit the movement of pedestal 60 with respect to frame 10. Hydraulic motor 66 is deactivated when either B1 engages LS1 or B2 engages LS2.

A length adjustable boom arm assembly 72 is pivotally mounted on the upper end of pedestal 60, as will now be described. Boom arm assembly 72 includes a hollow tube 74 which is positioned between support members 68 and 70 and which is pivotally secured thereto, about a horizontal axis, by a pivot pin assembly 76. Hydraulic cylinder 78 is pivotally connected to and extends between pedestal 60 and tube 74 for raising and lowering the boom arm assembly 72 relative to pedestal 60. Boom arm assembly 72 also includes a tube 80 which is slidably received within tube 74. Preferably, tube 80 is selectively manually slidably movable with respect to tube 74 although a hydraulic cylinder could be employed to move tube 80 with respect to tube 74 if so desired, although the same would increase the expense of the machine 10. Tube 80 is locked in either its extended position or in its retracted position by means of a removable pin 81 which extends through tubes 74 and 80.

Figure 3:
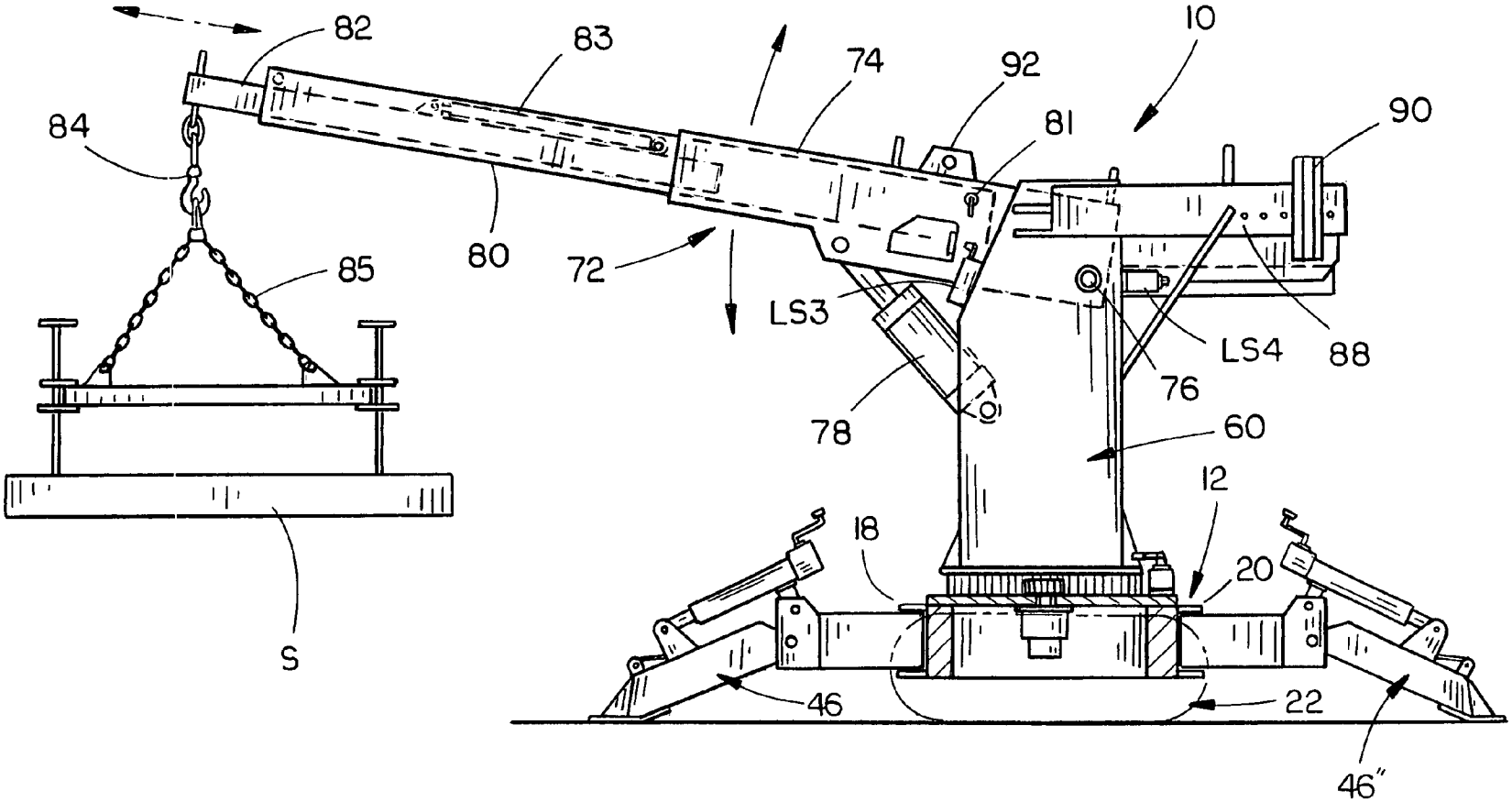
FIG. 3 is a side elevational view of the machine.

A tube 82 is slidably mounted in tube 80 and is selectively movable by means of a hydraulic cylinder 83 secured to and extending between tubes 80 and 82 within tube 80. The outer end of tube 82 has a lifting eye 84 secured thereto to which will be attached a conventional slat lifting or grasping tool 85 for raising or lowering slat S (FIG. 3).

Figure 6:
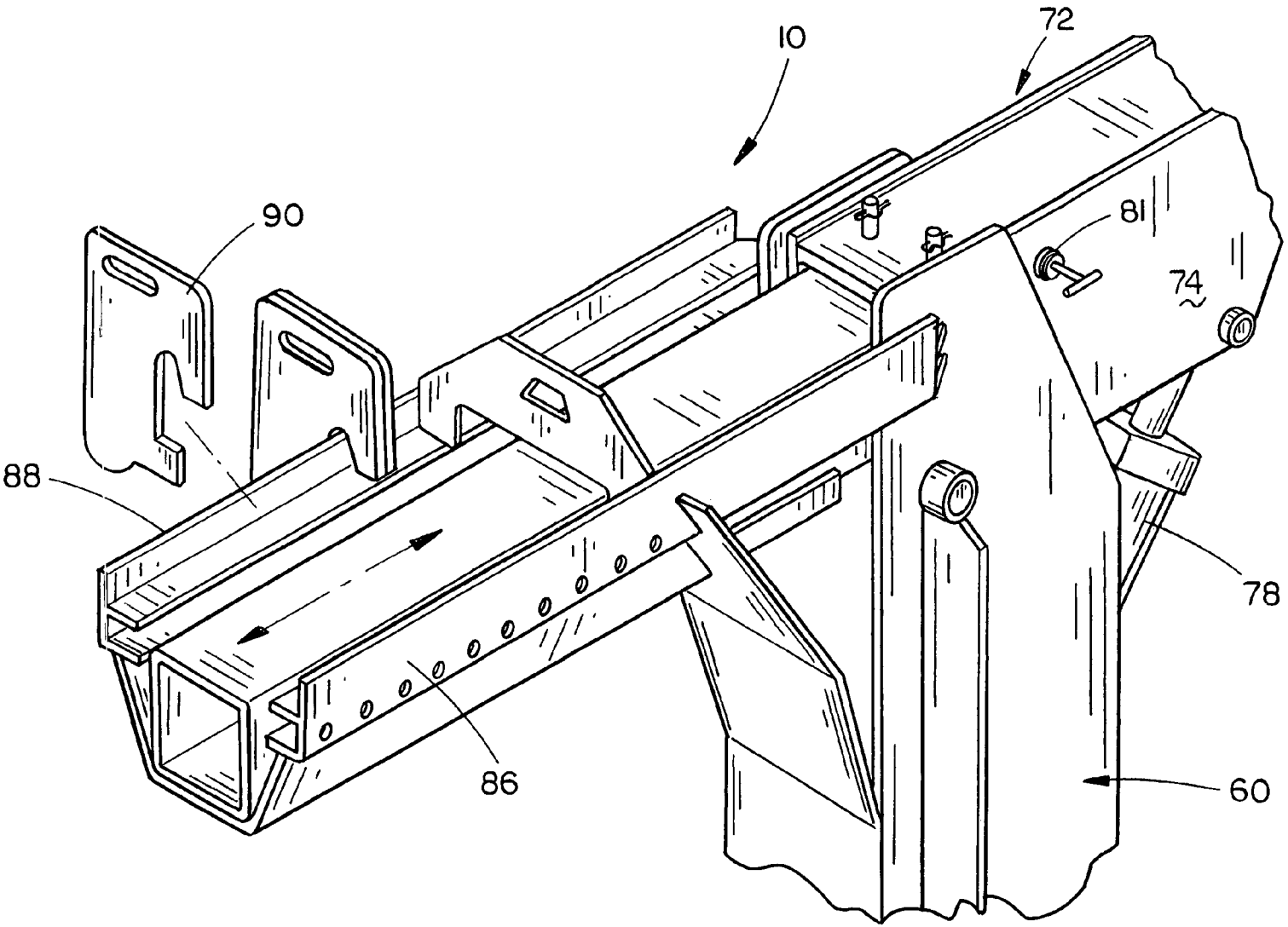
FIG. 6 is a partial rear perspective view of the machine.
Figure 7:
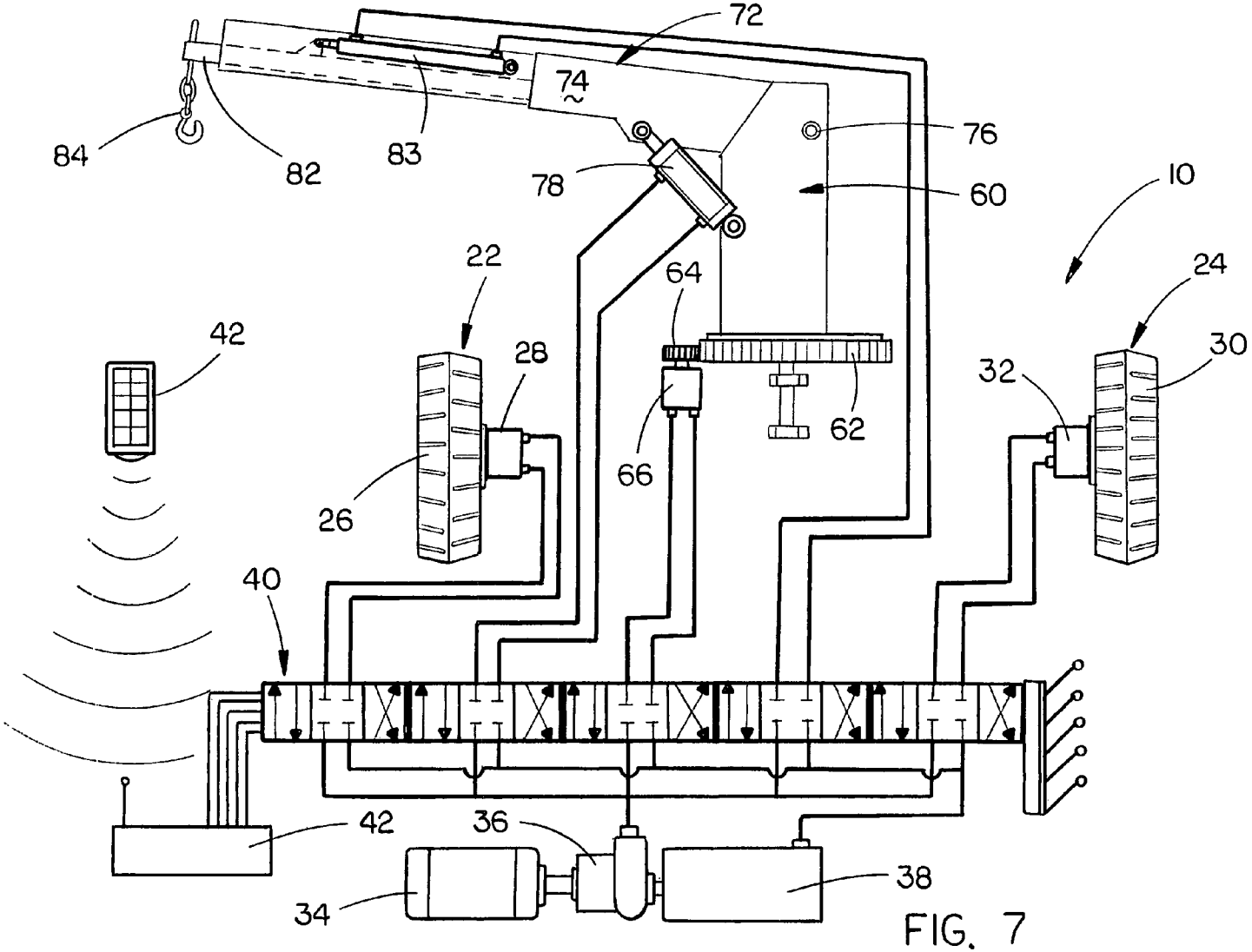
FIG. 7 is a schematic of the control and drive mechanism of the machine.

A pair of horizontally spaced-apart frame members or plates 86 and 88 are secured to and extend rearwardly from pedestal 60 and are each adapted to have counterweights 90 mounted thereon (FIG. 6). A lifting eye or hook 92 is secured to tube 74 so that a front end loader or crane may be attached thereto to enable the machine 10 to be lifted from the ground and moved into the building by way of a side or end window or lifted onto a transport vehicle or the like. Limit switches LS3 and LS4 are provided to limit the pivotal movement of the boom arm assembly 72 with respect to pedestal 60. When either LS3 or LS4 is actuated, hydraulic cylinder 78 is deactivated.

Figure 4:
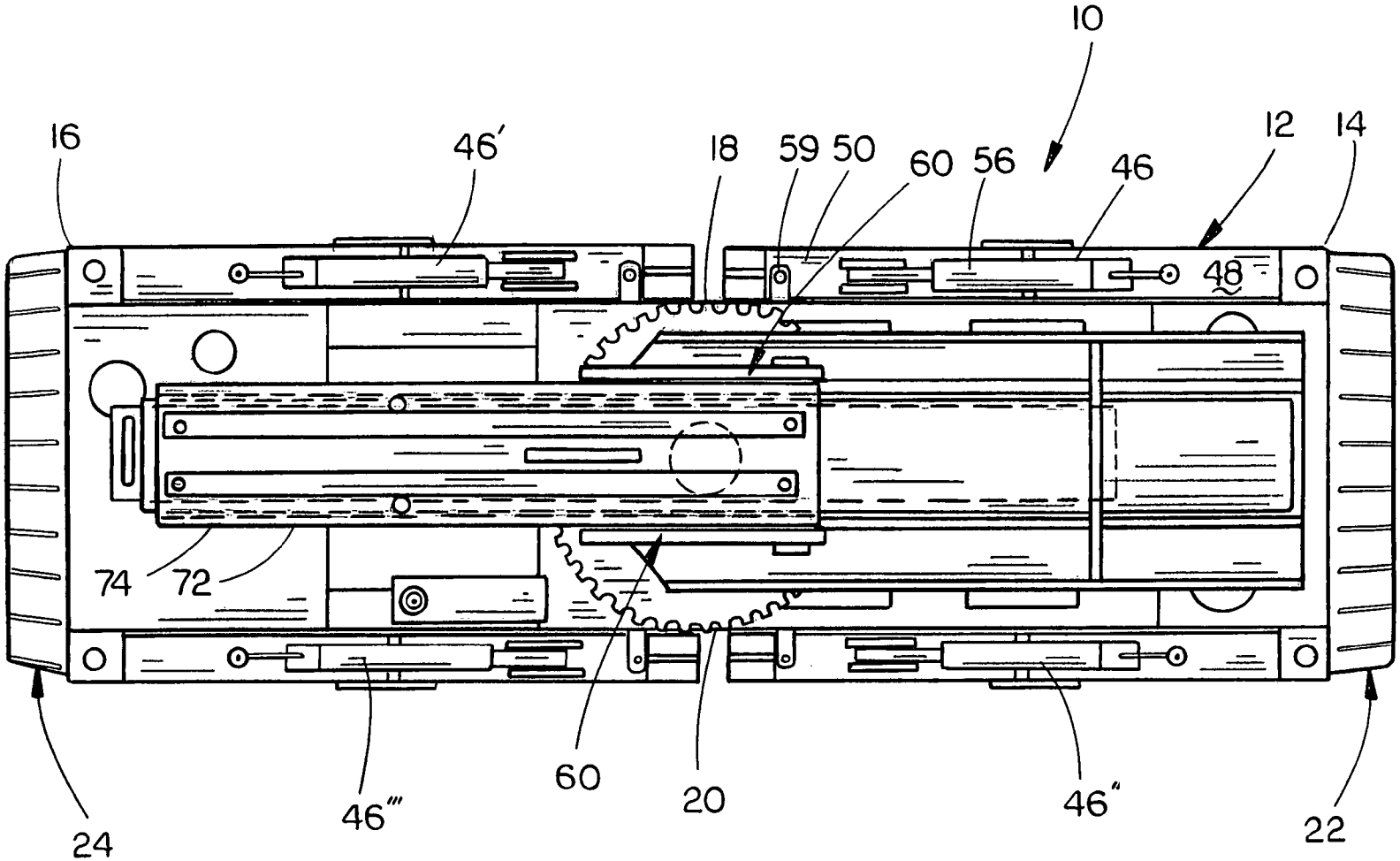
FIG. 4 is a top elevational view of the machine in its transport position.
Figure 5:
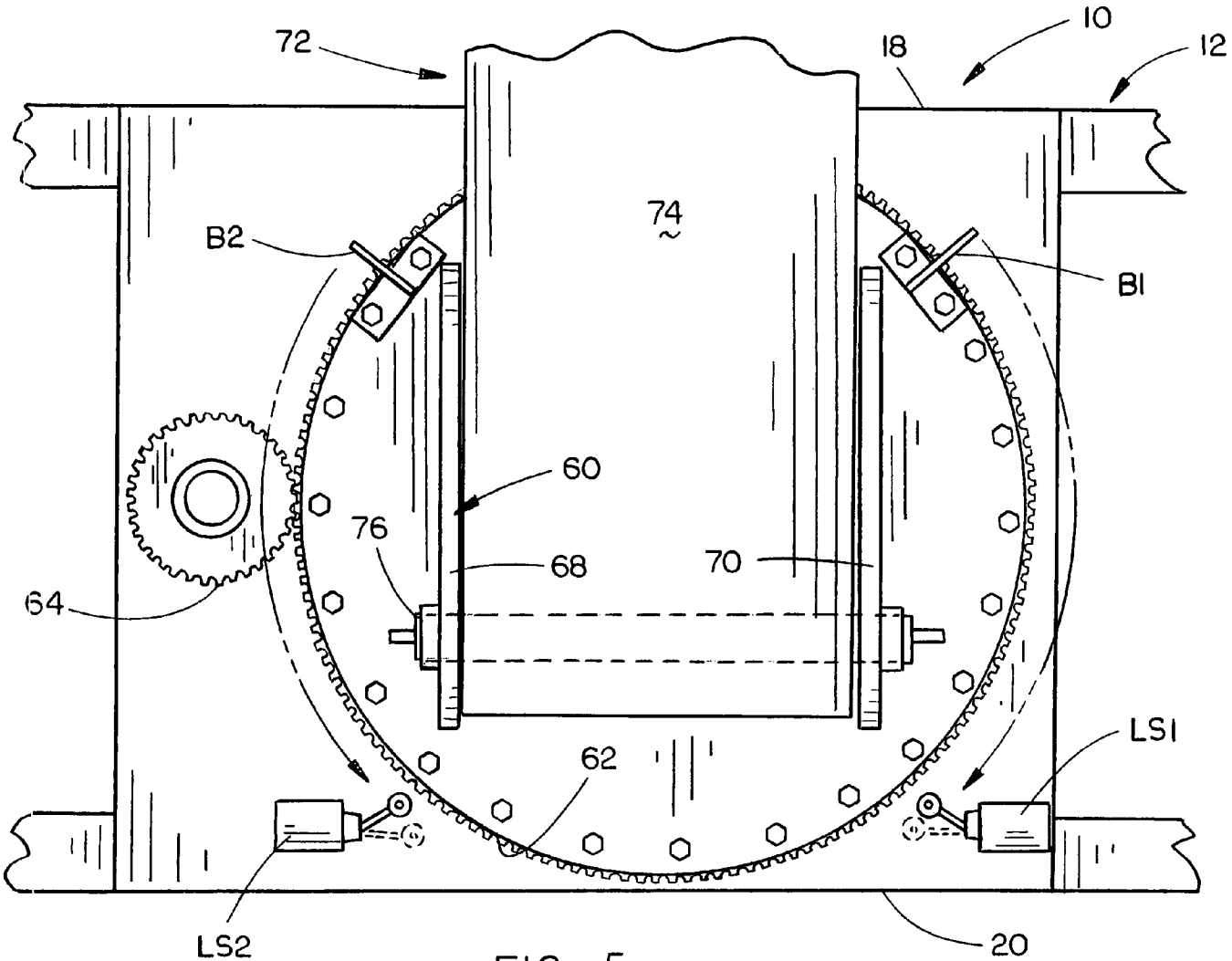
FIG. 5 is a partial top elevational view of the machine.

The machine of this invention is extremely versatile in that it may be positioned in the stowed or transport position of FIG. 4. In that position, the outrigger assemblies 46, 46', 46" and 46'" are folded against the frame and the tube 80 is slidably moved inwardly into tube 74 with tube 82 being retracted. In the position of FIG. 4, the machine may be placed upon a dolly or the like and moved through a standard thirty-six inch door. The machine may also be hoisted and lifted through a side or end window of the building.

Once the machine is within the building, it is lowered into engagement with a supporting surface, the outrigger assemblies 46, 46', 46" and 46'" are pivotally moved outwardly to their operative position and the screw actuators 56 are operated to lower the outer ends of the outrigger assemblies into engagement with the supporting surface. If both of the drive units 22 and 24 are moved in the same direction, the machine will either move forwardly or rearwardly. If one of the drive units is moved in one direction and the other drive unit is moved in the opposite direction, the machine has zero turn capability. The hydraulic control of the drive units 22 and 24 makes the machine extremely maneuverable and versatile. The machine may be steered much like a zero turn mower. The fact that the machine may be operated by remote control lessens the chances of injury to an operator since the operator does not need to stand by the machine or sit on the machine as is the case in certain prior art machines. The compactness and versatility as well as the maneuverability of the machine makes the job of replacing slats much easier and more readily accomplished.

Although the machine of this invention is ideally suited for use in replacing slats, the machine may have other uses as well.

Thus it can be seen that the invention accomplishes at least all of its stated objectives.

I claim:

1. A machine for removing and installing concrete slats in a livestock building, comprising:

an elongated, horizontally disposed frame having first and second ends and first and second sides;

a first selectively reversible drive unit at said first end of said frame;

a second selectively reversible drive unit at said second end of said frame;

said first and second reversible drive units supporting said frame above a supporting surface;

an upstanding pedestal rotatably mounted on said frame, about a vertical axis, between said first and second ends thereof;

a boom arm assembly, having inner and outer ends, pivotally secured to said pedestal, about a horizontal axis;

said outer end of said boom arm assembly adapted to support a slat therefrom;

and a power source on said frame for powering at least some of said drive units, said pedestal and said boom arm assembly;

a first elongated outrigger assembly having inner and outer ends;

said inner end of said first outrigger assembly being pivotally secured, about a vertical axis, to said first side of said frame adjacent said first end of said frame;

a second elongated outrigger assembly having inner and outer ends;

said inner end of said second outrigger assembly being pivotally secured, about a vertical axis, to said first side of said frame adjacent said second end of said frame;

a third elongated outrigger assembly having inner and outer ends;

said inner end of said third outrigger assembly being pivotally secured, about a vertical axis, to said second side of said frame adjacent said first end of said frame;

a fourth elongated outrigger assembly having inner and outer ends;

said inner end of said fourth outrigger assembly being pivotally secured, about a vertical axis, to said second side of said frame adjacent said second end of said frame;

each of said first, second, third and fourth outrigger assemblies being selectively pivotally movable with respect to said frame between operative and stowed positions;

said first and second outrigger assemblies, when in their said stowed positions, being positioned closely adjacent said first side of said frame;

said third and fourth outrigger assemblies, when in their said stowed positions, being positioned closely adjacent said second side of said frame;

said outrigger assemblies, when in their said stowed positions, being substantially parallel to the longitudinal axis of said frame.

2. The machine of claim 1 wherein each of said outrigger assemblies comprises an elongated first frame member, having opposite ends, pivotally secured at one end to said frame about a vertical axis and an elongated second frame member, having opposite ends, pivotally secured at one end thereof to the other end of said first frame member about a horizontal axis, and a length adjustable member pivotally secured to and extending between said first and second frame members for raising and lower the other end of said second frame member.

3. The machine of claim 2 wherein said length adjustable member comprises a manually operated jack means.

4. The machine of claim 1 wherein each of said drive units comprises an endless track driven by a reversible hydraulic motor.

5. The machine of claim 1 wherein at least some of the components of the machine are remotely radio controlled.

6. The machine of claim 1 wherein said drive units are individually selectively remotely radio controlled.

7. The machine of claim 1 wherein said boom arm assembly is selectively remotely radio controlled so that said boom arm assembly may be remotely raised and lowered.

8. The machine of claim 1 wherein a counterweight support is provided on said pedestal to enable counterweights to be supported directly thereon to counter the weight of said boom arm assembly and the slat supported thereby.

9. The machine of claim 8 wherein counterweights are selectively removably mounted on said counterweight support.

10. The machine of claim 8 wherein said counterweight support comprises first and second counterweight support members positioned on opposite sides of said boom arm assembly.

11. The machine of claim 1 wherein said boom arm assembly is selectively extendible.

12. The machine of claim 11 wherein said boom arm assembly comprises a first elongated tube, having first and second ends, which is pivotally secured to said pedestal about a horizontal axis, a second tube selectively slidably mounted in said first tube and a third tube selectively slidably mounted in said second tube.

13. The machine of claim 12 wherein a hydraulic cylinder is pivotally secured to and extends betweens said first tube and said pedestal.

14. The machine of claim 12 wherein a hydraulic cylinder is operatively secured to said third tube for slidably moving said third tube with respect to said second tube.

15. The machine of claim 14 wherein said second tube is selectively manually movable with respect to said first tube.

16. The machine of claim 12 wherein said second tube is selectively manually movable with respect to said first tube.

17. The machine of claim 16 wherein said third tube is movable with said second tube.

18. The machine of claim 1 wherein said frame has a length and a width and wherein said length is substantially greater than said width.

19. The machine of 1 wherein said boom arm assembly has a hoisting eye mounted thereon to enable the machine to be hoisted by another apparatus.

* * * * *